United States Patent [19]

Okada

[11] Patent Number: 4,718,672

[45] Date of Patent: Jan. 12, 1988

[54] SLOT MACHINE

[75] Inventor: Kazuo Okada, Tokyo, Japan

[73] Assignee: Kabushiki Kaisha Universal, Tochigi, Japan

[21] Appl. No.: 930,936

[22] Filed: Nov. 17, 1986

[30] Foreign Application Priority Data

Nov. 15, 1985 [JP] Japan ..... 60-174893[U]

[51] Int. Cl.[4] ..... G07F 17/34

[52] U.S. Cl. ..... 273/143 R; 273/138 A

[58] Field of Search ..... 273/138 A, 143 R, 143 A, 273/143 B; 340/323.2

[56] References Cited

U.S. PATENT DOCUMENTS 4,299,388 11/1981 Resch et al. ..... 273/143 R

FOREIGN PATENT DOCUMENTS 0070613 1/1983 European Pat. Off. ..... 273/138

0122138 10/1984 European Pat. Off. ..... 273/143 R

*Primary Examiner*—Theodore M. Blum

*Assistant Examiner*—Gilberto Barrón, Jr.

*Attorney, Agent, or Firm*—Young & Thompson

[57] ABSTRACT

In a slot machine, a specific winning line among a plurality of winning lines, e.g., an effective winning line or a winning line on which a winning symbol array appears, is optically identified. To identify a winning line or lines, series of light emitting diodes are disposed along the winning line or lines to selectively drive and illuminate the diode series. A liquid crystal display panel may be mounted in a display window. In this case, display patterns in front of the symbols are selectively flashed.

15 Claims, 8 Drawing Figures

SLOT MACHINE

BACKGROUND OF THE INVENTION

The present invention relates to a slot machine, and more particularly to an improved slot machine wherein at least one specified winning line among a plurality of possible winning lines can be recognized clearly by the player.

In a three-reel type slot machine for example, three reels with symbols disposed at the periphery thereof turn about respective horizontally mounted rotary shafts. After the three reels stop, three symbols appear in their display windows so that nine symbols, three lines and three rows, are displayed.

In most slot machines, commonly five combination lines i.e., five winning lines between symbols of the reels are provided: a first winning line combining three symbols appearing on the middle line, two second winning lines combining the respective three symbols appearing on the upper line and the lower line; and two third winning lines combining respectively three symbols appearing on the diagonal lines of the three-line-three-row matrix.

The number of potential winning lines among the five winning lines is determined depending upon the number of coins (including tokens) inserted prior to starting a game. For instance, if a single coin is inserted, only the first winning line is made effective and the second and third winning lines are neglected at the time of the winning judgment after the stopping of reel rotation. If two coins are inserted, three winning lines including the first and second winning lines are made effective so that combinations of symbols on these three winning lines become the objects of the winning judgment.

Since the effective winning lines change for each game, it is desirable to indicate to the player what winning lines are made effective. To this end, narrow lines, which do not become an obstacle to viewing the symbols, and which represent winning lines, have been printed heretofore on the display windows and a lamp is provided on the left side of each narrow line, thereby displaying the effective winning line or lines by turning on or flashing the lamps.

In such conventional winning line displays, since a single lamp illumination or flashing is conducted outside of the display window, it is somewhat difficult for the player to clearly recognize the effective winning lines.

Furthermore, if a game is played using a plurality of effective winning lines, with no means to discriminate the line that actually wins, the player faces a difficulty for the following game. Namely, after the reels stop, a microcomputer of the slot machine checks symbol arrays on the plural possible winning lines. If there is a winning symbol array, a number of coins corresponding to that winning symbol array are ejected. In this case, the player cannot recognize at once which line has a win.

SUMMARY OF THE INVENTION

It is therefore an object of the present invention to provide a slot machine which can discriminate specific winning lines, e.g., effective winning lines or winning lines on which winning symbol arrays appear, from the other possible winning lines.

To achieve the above and other objects and advantages of the present invention, the symbols on a specific winning line are displayed optically and differentiated from the other symbols. According to a preferred embodiment of the present invention, a transparent support member is mounted along each possible winning line or at the periphery of each symbol on the possible winning line, the support member being provided with light emitting elements such as light emitting diodes. Since the support member is of an elongated rod shape having a small cross section, viewing a symbol cannot be hindered even if the member is superposed on the winning line. According to another embodiment of the present invention, a liquid crystal panel is used which has a plurality of display patterns corresponding to symbols. In this case, display patterns coinciding with symbols on a specific winning line are flashed.

This specific winning line includes an effective winning line caused by coin insertion, a winning line with a winning symbol array, and the like. In cases wherein winning lines selected by coin insertion or by a select switch are displayed at the start of a game, it is preferable to display only a specific winning line on which a winning symbol array appears, at the end of the game.

DETAILED DESCRIPTION OF THE PREFERRED EMBODIMENTS

Figure 1:
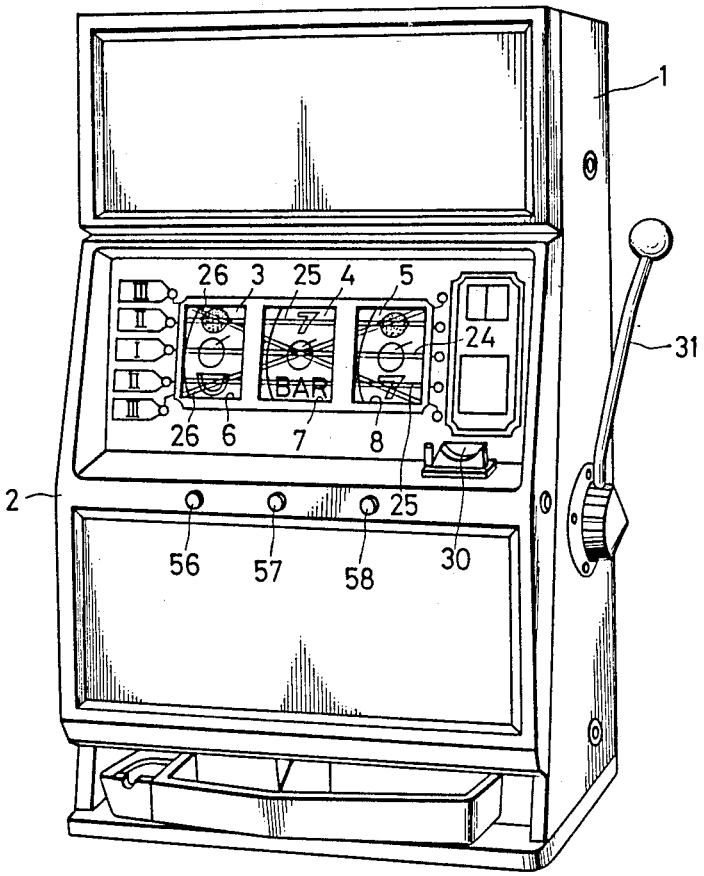
FIG. 1 shows the outer appearance of a slot machine according to the present invention.

Referring to FIG. 1 showing the outer appearance of a slot machine according to the present invention, mounted on the front panel of a main body 1 of the slot machine is a front door 2 which can be opened and closed. Symbols disposed on the outer periphery of first to third reels 3 to 5 mounted on the main body 1, can be viewed through first to third display windows 6 to 8, three symbols in each display window. Each display window 6 to 8 has a transparent glass 28 covering it (refer to FIG. 2).

Figure 2:
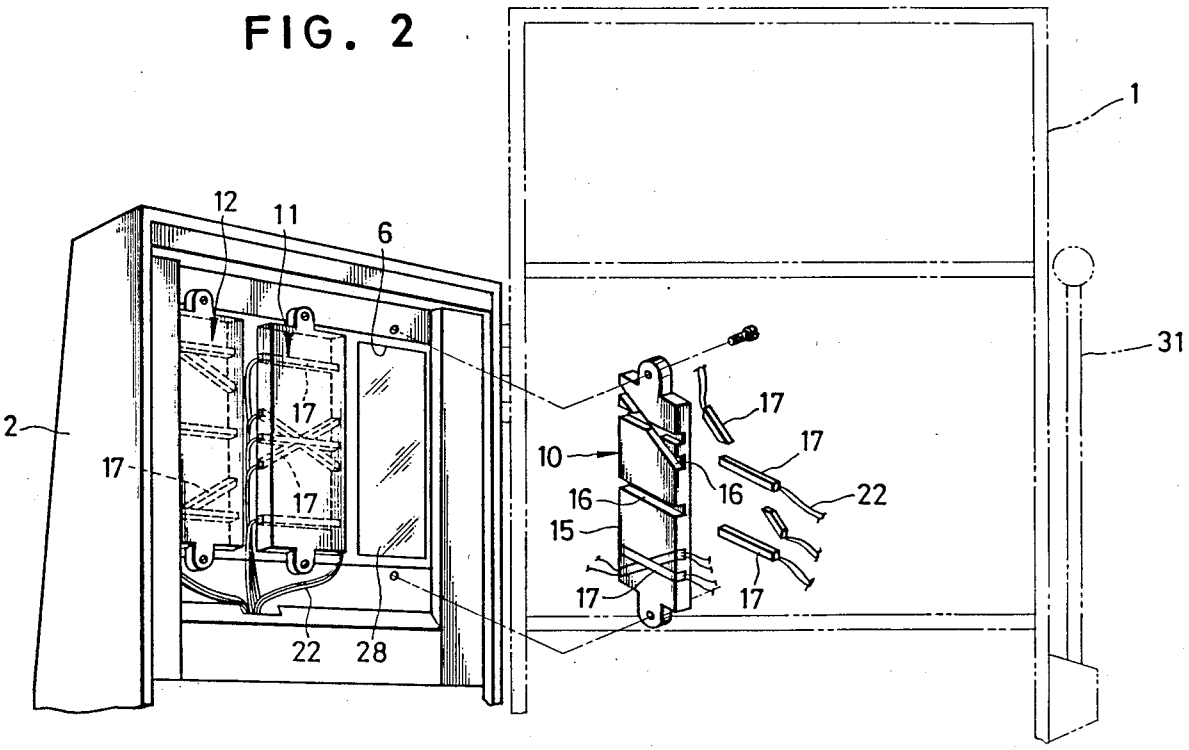
FIG. 2 is a perspective view showing the main part of the slot machine according to the present invention.
Figure 3:
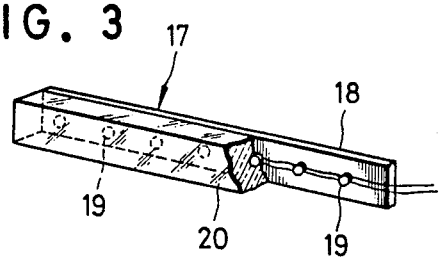
FIG. 3 is a perspective view partially in section showing an example of a line display member.

As shown in FIG. 2, on the back of each display window 6 to 8, a display plate 10 to 12 is mounted. EAch of the display plates 10 to 12, as exemplified by display plate 10, is constructed of a transparent acrylic plate 15, and line display members 17 inserted in grooves 16 formed on the one side of the acrylic plate 15. The line display member 17 is constructed, as shown in FIG. 3, of a support plate 18 made of transparent acrylic resin, light emitting diodes (LEDs) 19 spaced apart in the longitudinal direction of the support plate 18, and a rod member 20 made of transparent acrylic resin and covering all the light emitting diodes 19. The rod member 20 is a rectangular parallelepiped whose cross section is 1.5×1.5 mm for example, the interval of the light emitting diodes 19 being about 5 mm. Reference numeral 22 represents lead wires for the light emitting diodes 19 which may be connected in series or in parallel.

Line display members constructed as above are prepared, each of which has an appropriate length for insertion into grooves 16 of various lengths formed at the time of producing the acrylic plate 15, thus completing the above-described display plates 10 to 12. The line display members 17 mounted on the display plates 10 to 12 form the first and second winning lines 24 and 25, and two oblique third winning lines 26, as shown in FIG. 1. The line display members 17 are securely fitted in the grooves 16 of the acrylic plate 15. The display plates 10 to 12 are press-attached to the transparent glasses 28 of the first to third display windows 6 to 8.

Figure 6:
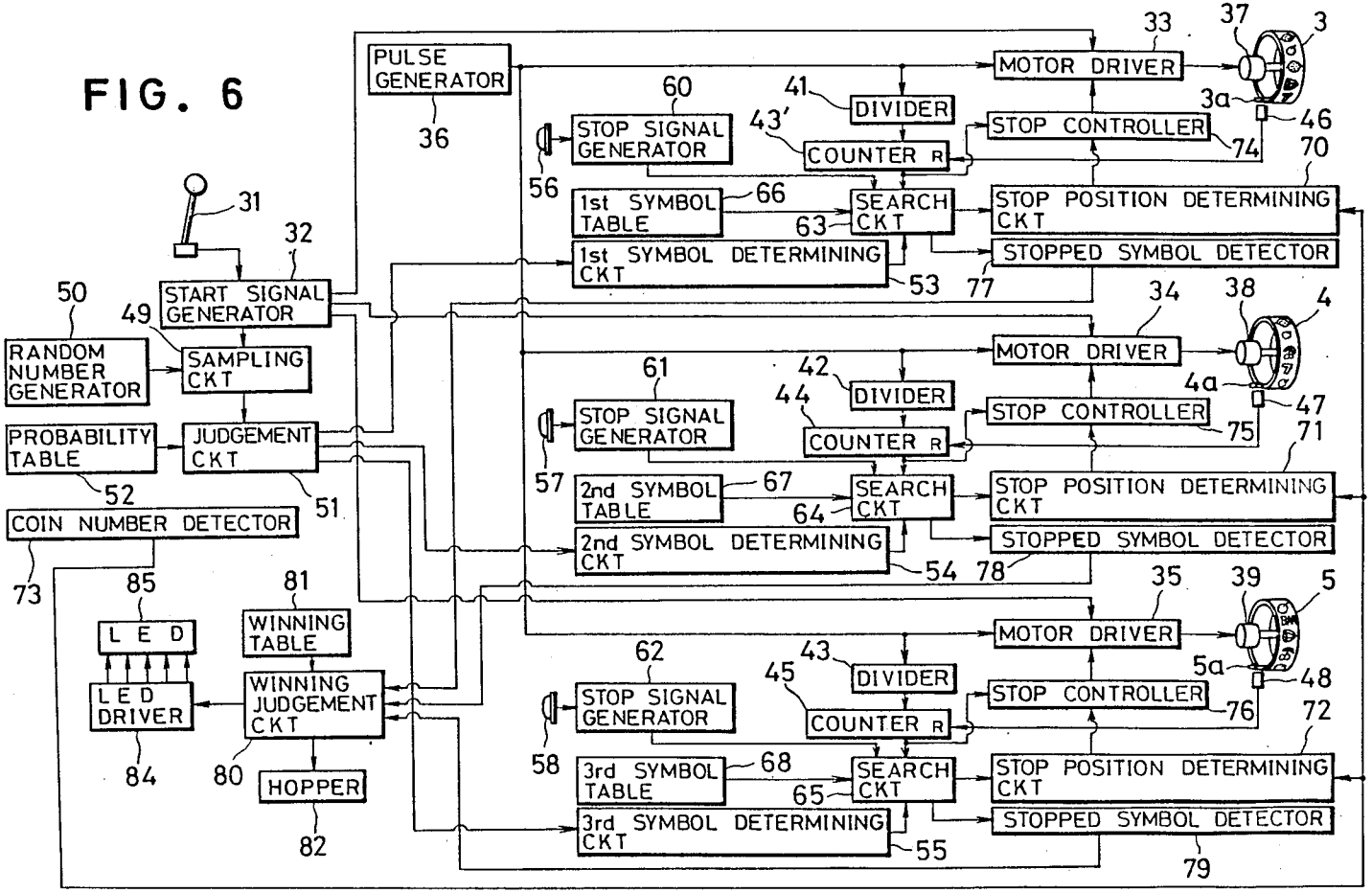
FIG. 6 is an electric circuit diagram of the slot machine according to the present invention.

Upon operating a start lever 31 after inserting three coins for example into a coin inlet 30, the game starts in accordance with the operation of the circuit shown in FIG. 6. A start pulse is generated from a start signal generator 32 to activate motor drivers 33, 34 and 35 for the respective reels 3 to 5. The motor drivers 33 to 35 make stepping motors 37, 38 and 39 rotate by supplying a pulse train from the pulse generator 36 thereto. The stepping motors 37 to 39 are rotated through a certain angle corresponding to the number of pulses supplied from the pulse generator 36, to correspondingly drive the reels 3 to 5.

Pulses to be supplied to the motor drivers 33 to 35 are frequency-divided by dividers 41, 42 and 43 in such a manner that the pulses necessary for rotating the reels by one symbol are divided into one pulse which is counted by each of counters 43', 44 and 45. Light shielding members *3a* to *5a* are integrally formed on the respective reels 3 to 5 to deliver a reset signal from each photosensor 46, 47 and 48 every time each reel 3 to 5 completes one full revolution. The reset signal is inputted to each reset terminal of the counters 43 to 45 to reset the count to "0".

Since the symbols on the outer periphery of the reels 3 to 5 and at the reference positions of the light shielding members can be identified, the rotary position of the reels 3 to 5 during one rotation can unconditionally be detected based on the count of the counters 43 to 45. Therefore, the symbols appearing in the display windows 6 to 7 can also be determined.

A sampling circuit 49 is activated upon reception of the start signal from the start signal generator 32 to sample randomly a random number from a random number generator 50 which generates repetitively a random number series within a predetermined number range. A random number may include an integer sampled from a definite integer series at a predetermined period. A judgment circuit 51 refers the sampled random number to the values of a probability table 52 and judges to which group the sampled number belongs, the groups being divided in correspondence with the number of coins to be dispensed.

In the probability table 52 constructed of ROMs, a certain integer series is divided into four groups for example, to which integer group a bit hit, a medium hit, a small hit, and a miss are respectively assigned. The big hit has a minimum occurrence probablity, upon which big hit a game of a special favor such as a bonus game can be played. 15 coins are allotted to the medium hit, 10 coins to the small hit, and no coin to the miss, the occurrence probability increasing in this order.

When a sampled random number corresponds to the medium hit, the judgment circuit 51 sets a medium hit flag. 1st, 2nd and 3rd symbol-determining circuits 53 to 55 then determine the symbol code numbers of symbols of the reels 3 to 5, which symbols establish a medium hit combination.

After a lapse of a certain time after the onset of rotation of the reels 3 to 5, the reels 3 to 5 reach a constant speed whereupon stop buttons 56 to 58 can be manipulated. The stop buttons 56 to 58 are provided, as shown in FIG. 1, for each reel 3 to 5 and are manipulated by the operator to generate a stop signal for the reels 3 to 5. Upon sequential manipulation of the stop buttons 56 to 58, a stop signal is outputted from stop signal generators 60 to 62 to search circuits 63 to 65. Then, the search circuits 63 to 65 search, while referring to 1st to 3rd symbol tables 66 to 68 wherein the symbol arrangements on the 1st to 3rd reels 3 to 5 are stored as symbol code numbers, a most suitable reel stop position corresponding to the symbol code numbers set in the 1st to 3rd symbol-determining circuits 53 to 55, and actuate stop position determining circuits 70 to 72.

Particularly, in the case of a plurality of effective winning lines among the possible winning lines 24 to 26, the stop position of each reel 3 to 5 is secured in order that the hit determined by the probability table 53 may be obtained on the effective winning lines. To this end, the stop position determining circuits 70 to 72 are inputted with a signal as to the number of effective winning lines from a coin number detector 73 which detects the number of coins inserted.

To avoid a uniform symbol combination constituting a hit, the operation program of the 1st to 3rd symbol determining circuits 53 to 55 is constructed such that different symbol combinations constituting a medium hit for example are made available when a medium hit flag is set in the judgment circuit 51. Alternatively, a symbol combination may previously be determined for each random number. In this case, although the capacity of the probability table 52 must be large, the 1st to 3rd symbol-determining circuits 53 to 55 can be omitted.

After determining the stopped position of the reels 3 to 5, stop controllers 74 to 76 start operating while referring to the count of the counters 43 to 45, and make the stepping motors 37 to 39 gradually reduce their speed and stop at the stop position determined by the stop position determining circuits 70 to 72. In the case of an automatic reel stop type slot machine, the above-described stop control starts after a lapse of a predetermined time.

After the reels 3 to 5 stop at a most suitable stop position, the symbol code numbers corresponding to the symbols appearing in the display windows 6 to 8 are set to stop symbol detectors 77 to 79, and inputted to a winning judgment circuit 80. The winning judgment circuit 80 judges, while referring to a winning table 81, how many numbers of coins are to be allocated for the respective symbol combinations on the possible winning lines 24 to 26. For instance, if there is a medium hit symbol combination on one of the 3rd winning lines 26 among the effective winning lines 24 to 26, the winning judgment circuit 80 actuates a hopper 82 to pay 15 coins for the medium hit and to dispense them into a saucer 83 (FIG. 1).

Simultaneously therewith, the winning judgment circuit 80 outputs to an LED driver 84 a signal representative of a win on one of the 3rd winning lines 26. As a result, the LED driver 84 turns on the line display members 17 disposed along one of the 3rd winning lines 26 on which the medium hit symbols appear. Namely, the display members 17 mounted on the respective display plates 10 to 12 are selected to turn on only those members forming a pattern displaying one of the 3rd winning lines 26. In this case, if the surface of the arcylic rod members 20 is made coarse, light from the light emitting diodes 19 is diffused so that a display of the winning line can be effectively performed. The display of the winning line may be effected by continuously turning on the light emitting diodes 19 or by flashing them. The lead wires 22 of the line display member 17 are drawn within the frames of the 1st to 3rd display windows 6 to 8 and are not visible through the display windows 6 to 8.

As above, with the combination of the symbols constituting a win and the line display members 17 superposed thereon, it is possible for the player to recognize at once the winning line 26 as well as its winning symbol array, thus adding to the enjoyment of the game.

Figure 4:
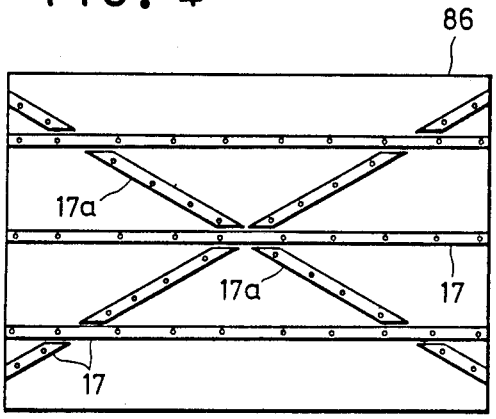
FIG. 4 diagrammatically shows an example of a pattern of line display members.
Figure 5:
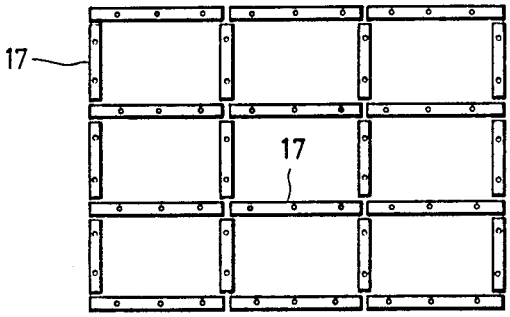
FIG. 5 diagrammatically shows another example of a pattern of line display members.

FIGS. 4 and 5 show other examples of a pattern of the line display members 17. In the example of FIG. 4, instead of independent acrylic plates 15 provided for the respective display windows 6 to 8 as in the above embodiment, a single acrylic plate 86 is used in common to all three windows so that minutely divided line display members 17 are not needed. The lead wires for the oblique line display members **17*a* are drawn along the members 17*a* or other members 17 so that they can be pulled out from one end of the acrylic plate 86** without impairing the view of the symbols and winning lines.

In the example of FIG. 5, line display members 17 are constructed as a matrix so that each symbol constituting a win can be surrounded by illuminated members 17. As described for the embodiment of FIG. 2, not only may the winning lines be illuminated after the stopping of the reels 3 to 5, but also the effective winning lines among a plurality of possible winning lines may be illuminated simultaneously with the start of rotation of the reels 3 to 5.

Figure 7:
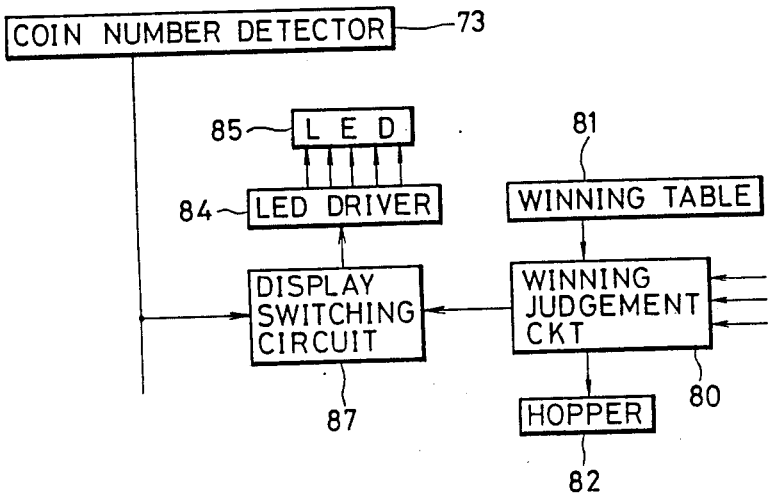
FIG. 7 is a block diagram showing the main part of an embodiment of the present invention, wherein possible winning lines and winning lines on which winning symbol arrays appear are selectively displayed.

FIG. 7 illustrates another embodiment wherein actual winning lines and winning symbol arrays are selectively displayed. In this embodiment, a display switching circuit 87 is provided, which first functions to display the actual winning lines caused by coin insertion. As described previously, after each reel is manually or automatically stopped, a signal from the winning judgment circuit 80 turns on only the winning lines for the winning symbol arrays until the next coin insertion is effected. Therefore, the player can recognize which winning lines indicate a hit. Not only the effective winning lines, but also all the winning lines for the winning symbol arrays may be illustrated.

Figure 8:
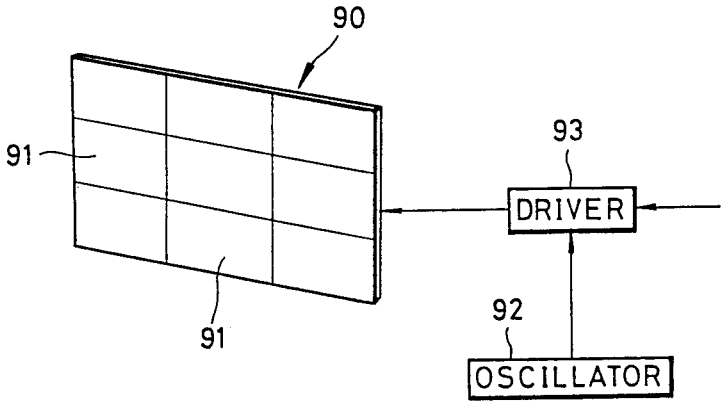
FIG. 8 is a view illustrating another embodiment of the present invention, wherein a liquid crystal panel is used.

FIG. 8 shows a further embodiment of the present invention using a liquid crystal panel. A liquid crystal panel 90 is mounted at the back of the display windows 6 to 8. The liquid crystal panel 90 has a plurality of display patterns 91 corresponding to the 3×3 symbol matrix. Under ordinary conditions, all the display patterns 91 are in a light transmitting state. The display patterns on an effective winning line have alternately a light transmitting state and a light shielding state to flash at a relatively long period, by means of an oscillator 92 and a driver 93. After a winning judgment, only those patterns on a winning line flash. Since lamps for illuminating the reels are mounted inside the display windows 6 to 8, symbols can be clearly recognized even if a liquid crystal panel 90 is used.

What is claimed is:

1. A slot machine having N symbol series which are movable and disposed side by side, each symbol series having a plurality of symbols disposed at a predetermined pitch, a display window through which M symbols of each symbol series are visible, N and M each being an integer greater than 2, and a plurality of winning lines corresponding to straight lines on an N×M symbol matrix displayed in the display window, comprising:

a plurality of transparent rod support members superposed on said display window along said winning lines;

a plurality of light emitting elements mounted on each said support member; and means for selecting at least one winning line and for controlling the illumination of a plurality of said light emitting elements disposed along said at least one selected winning line.

2. A slot machine according to claim 1, wherein said symbol series are mounted on the outer periphery of a rotatable reel.

3. A slot machine according to claim 1, wherein said light emitting element is a light emitting diode.

4. A slot machine according to claim 1, wherein each said transparent support member is an acrylic plate.

5. A slot machine according to claim 1, wherein said illumination control means controls the display of the winning line along which a predetermined winning symbol array appears.

6. A slot machine according to claim 1, wherein said illumination control means controls the selection of the winning lines corresponding to the number of coins inserted before said reels stop and illuminates the selected winning line.

7. A slot machine having N symbol series which are movable and disposed side by side, each symbol series having a plurality of symbols disposed at a predetermined pitch, a display window through which M symbols of each symbol series are visible, N and M each being an integer greater than 2, and a plurality of winning lines corresponding to straight lines on an N×M symbol matrix displayed in the display window comprising:

a plurality of transparent rod support members each disposed surrounding each symbol constituting said symbol matrix;

a plurality of light emitting elements mounted on said support member; and means for selecting at least one winning line and for controlling the illumination of a plurality of said light emitting elements disposed surrounding N symbols on said at least one selected winning line.

8. A slot machine according to claim 7, wherein said symbol series are mounted on the outer periphery of a rotatable reel.

9. A slot machine according to claim 7, wherein said light emitting element is a light emitting diode.

10. A slot machine according to claim 7, wherein each said transparent support member is an acrylic plate.

11. A slot machine according to claim 7, wherein said illumination control means controls the illumination of the winning line along which a predetermined winning symbol array appears.

12. A slot machine according to claim 7, wherein said illumination control means controls the selection of the winning lines corresponding the the number of coins inserted before said reels stop and illuminates the selected winning line.

13. A slot machine having N symbol series which are movable and disposed side by side, each symbol series having a plurality of symbols disposed at a predetermined pitch, a display window through which M symbols of each symbol series are visible, N and M each being an integer greater than 2, and a plurality of winning lines corresponding to straight lines on an N×M symbol matrix displayed in the display window, comprising:

a liquid crystal display panel disposed between said N symbol series and said display window and formed with a plurality of display patterns coinciding with the symbols constituting said symbol matrix; and flashing control means whereby at least one winning line is selected, and the display patterns corresponding to N symbols on said selected winning line take alternatingly a light transmitting state and a light shielding state to flash said symbols on said selected winning line.

14. A slot machine according to claim 13, wherein said symbol series are mounted on the outer periphery of a rotatable reel.

15. A slot machine according to claim 13, wherein said flashing control means controls the flashing of the winning line along which a predetermined winning symbol array appears.

* * * * *